US009567785B2

(12) United States Patent
Wang et al.

(10) Patent No.: US 9,567,785 B2
(45) Date of Patent: Feb. 14, 2017

(54) HINGE

(71) Applicant: DINMEX MFG., INC., New Taipei (TW)

(72) Inventors: Grace Wang, New Taipei (TW); Jackie Wu, New Taipei (TW); Jennifer Wu, New Taipei (TW); Andy Wu, New Taipei (TW)

(73) Assignee: Dinmex Mfg., Inc., New Taipei (TW)

( * ) Notice: Subject to any disclaimer, the term of this patent is extended or adjusted under 35 U.S.C. 154(b) by 279 days.

(21) Appl. No.: 14/560,164

(22) Filed: Dec. 4, 2014

(65) Prior Publication Data

US 2015/0368951 A1 Dec. 24, 2015

(30) Foreign Application Priority Data

Jun. 20, 2014 (TW) ..... 103121476 A

(51) Int. Cl.

| | |
|---|---|
| ***E05D 5/02*** | (2006.01) |
| ***E05D 11/02*** | (2006.01) |
| ***E05D 3/02*** | (2006.01) |
| ***E05F 1/12*** | (2006.01) |
| *E05D 7/081* | (2006.01) |

(52) U.S. Cl.

CPC ..... *E05D 11/02* (2013.01); *E05D 3/02* (2013.01); *E05D 5/0246* (2013.01); *E05F 1/1253* (2013.01); *E05D 7/081* (2013.01); *E05Y 2900/132* (2013.01); *Y10T 16/293* (2015.01)

(58) Field of Classification Search

CPC ..... E05D 11/02; E05D 3/02; E05D 5/0246; E05D 7/081; E05D 11/1064; E05F 1/1253; E05Y 2900/132; Y10T 16/293; Y10T 16/534

See application file for complete search history.

(56) References Cited

U.S. PATENT DOCUMENTS

| | | | | |
|---|---|---|---|---|
| 6,161,255 | A * | 12/2000 | Garrett | A47K 3/36 16/284 |
| 6,519,811 | B1 * | 2/2003 | Cheng | E05D 5/0246 16/252 |
| 6,925,685 | B2 * | 8/2005 | Chen | E05D 5/0246 16/239 |
| 6,966,150 | B2 * | 11/2005 | Chiang | E05D 5/0246 16/252 |
| 7,010,832 | B2 * | 3/2006 | Chen | E05D 5/0246 16/235 |

(Continued)

*Primary Examiner* — Victor Batson
*Assistant Examiner* — Matthew Sullivan
(74) *Attorney, Agent, or Firm* — Rosenberg, Klein & Lee

(57) ABSTRACT

A hinge has a pivot assembly and a holding assembly. The pivot assembly has a securing panel, a connecting seat, a pivot shaft, and two positioning sets. Each of the positioning sets has a positioning ball and a silencing positioning element filled with lubricating grease. The holding assembly has two holding sheets holding the pivot shaft. With the holding sheets and the pivot shaft abutting each other with tooth or embossed surfaces, friction between the holding sheets and the pivot shaft is increased. Thus, the pivot shaft and the holding sheets do not pivot relative to each other easily. The lubricating grease in the silencing positioning elements can be smeared on the positioning balls, such that the positioning balls can smoothly roll on the pivot shaft without abrasion and no noise will occur.

15 Claims, 9 Drawing Sheets

(56) References Cited

U.S. PATENT DOCUMENTS

| | | | | |
|---|---|---|---|---|
| 7,107,723 | B2 * | 9/2006 | Chiang | E05D 5/0246 49/388 |
| 7,127,777 | B2 * | 10/2006 | Chiang | E05D 5/0246 16/235 |
| 7,305,796 | B2 * | 12/2007 | Chiang | E05D 5/0246 16/252 |
| 7,305,797 | B2 * | 12/2007 | Chiang | E05D 5/0246 16/252 |
| 9,297,191 | B1 * | 3/2016 | Chen | E05D 5/02 |
| 2004/0020130 | A1 * | 2/2004 | Chiang | E05D 5/0246 49/388 |
| 2008/0083087 | A1 * | 4/2008 | Lin | E05D 11/1064 16/252 |
| 2008/0168621 | A1 * | 7/2008 | Lin | E05D 11/1064 16/252 |
| 2012/0079682 | A1 * | 4/2012 | Cheng | E05D 11/1064 16/252 |

* cited by examiner

HINGE

BACKGROUND OF THE INVENTION

1. Field of the Invention

The present invention relates to a hinge, especially to a hinge for a glass door, such that the glass door can quietly and exactly return to a closed position.

2. Description of the Prior Art(s)

A hinge is used for mounting a glass panel on a doorframe of a building. With reference to FIG. 7, a conventional hinge comprises a pivot assembly 40 and a holding assembly 30. The pivot assembly 40 has a positioning set. The holding assembly 30 is connected to the pivot assembly 40 via a pivot shaft. The pivot shaft has two ends. One of the ends of the pivot shaft is held by the holding assembly 30. The other end of the pivot shaft is rotatably mounted in the pivot assembly 40 and selectively engages with the positioning set, so as to hold the pivot shaft and the holding assembly 30 in a closed position.

Two of the conventional hinges can be respectively mounted on an upper edge and a lower edge of a glass panel 70 and disposed adjacent to a side edge of the glass panel 70. The holding assemblies 30 securely hold the glass panel 70. The pivot assemblies 40 are respectively attached to a ceiling and a ground. The pivot shafts of the two conventional hinges align with each other and form a pivot axis. Thus, as the glass panel 70 rotates, the glass panel 70, the holding assemblies 30, and the pivot shafts pivot around the pivot axis accordingly.

Moreover, as shown in FIG. 7, in some places, such as a bathroom, the pivot assembly 40 of one of the two conventional hinges may be attached to a wall 60 via a bracket 50. Thus, a gap is formed between the ceiling and the upper edge of the glass panel or between the ground and the lower edge of the glass panel. Accordingly, the bathroom can be properly ventilated.

With further reference to FIGS. 8 and 9, however, the wall 60 may be uneven or inclined, causing declination of the brackets 50 and the conventional hinges. Therefore, the holding assemblies 30 of the conventional hinges are supposed to be adjustable, so as to allow the holding assemblies 30 of the conventional hinges to hold the glass panel 70 at the same time. However, in the conventional hinge, the holding assembly and the pivot shaft abut each other with smooth surfaces, and the positioning set of the pivot assembly applies torque on the pivot shaft. Thus, the holding assembly 30 and the pivot shaft slide and rotate relative to each other easily. Accordingly, the glass panel is unable to return to the closed position accurately. Moreover, in the conventional hinge, the positioning set is directly in contact with the pivot shaft without any lubricant. Therefore, as the pivot shaft pivots, the pivot shaft and the positioning set abrade and noise occurs.

To overcome the shortcomings, the present invention provides a hinge to mitigate or obviate the aforementioned problems.

SUMMARY OF THE INVENTION

The main objective of the present invention is to provide a hinge that comprises a pivot assembly and a holding assembly. The pivot assembly includes a securing panel, a connecting seat securely mounted on the securing panel, a pivot shaft rotatably mounted through the connecting seat, and two positioning sets mounted in the connecting seat. Each of the positioning sets has a silencing positioning element mounted in the pivot shaft and filled with lubricating grease, a positioning ball, an end cap, and a resilient element having two ends respectively pushing against the positioning ball and the end cap. The holding assembly includes two holding sheets.

With the holding sheets and the pivot shaft abutting each other with toothed or embossed surfaces, friction between the holding sheets and the pivot shaft is increased. Thus, the pivot shaft and the holding sheets do not pivot relative to each other easily. The lubricating grease in the silencing positioning elements can be smeared on the positioning balls, such that the positioning balls can smoothly roll on the pivot shaft without abrasion and no noise will occur.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
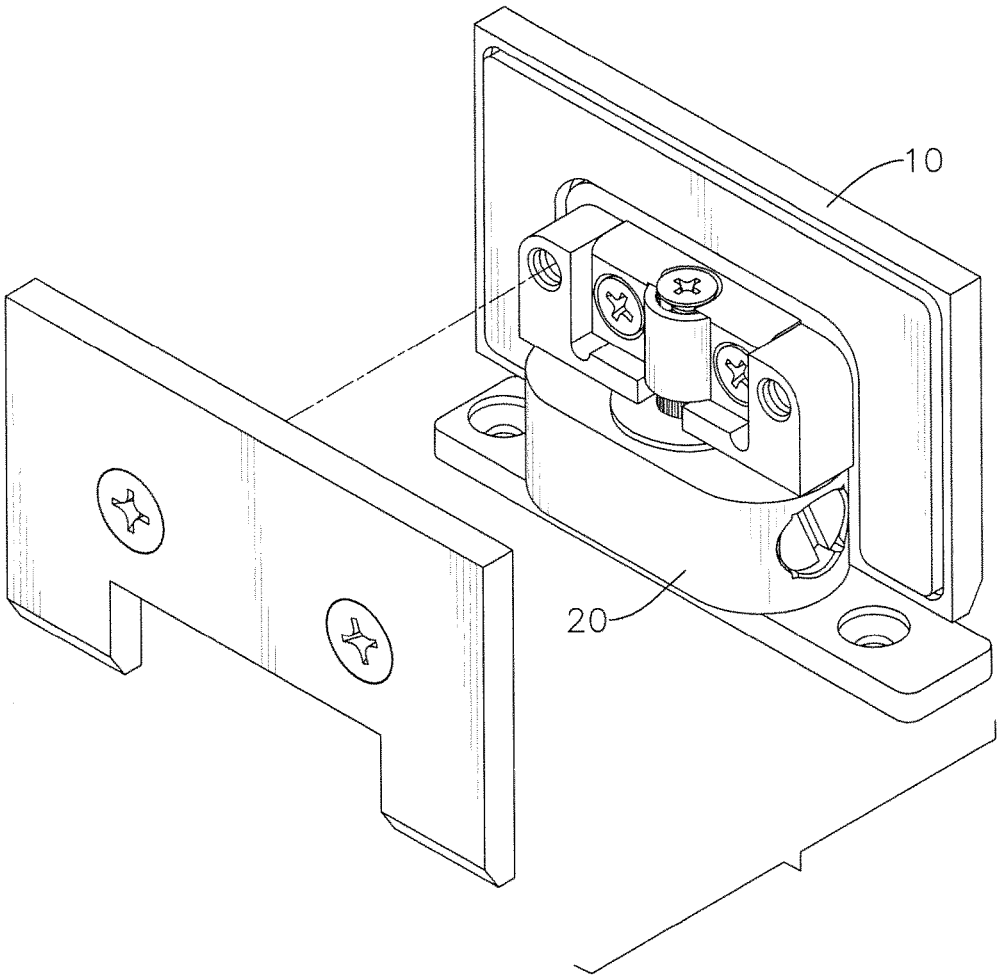
FIG. 1 is a first exploded perspective view of a hinge in accordance with the present invention.

With reference to FIG. 1, a hinge in accordance with the present invention comprises a pivot assembly 20 and a holding assembly 10.

Figure 2:
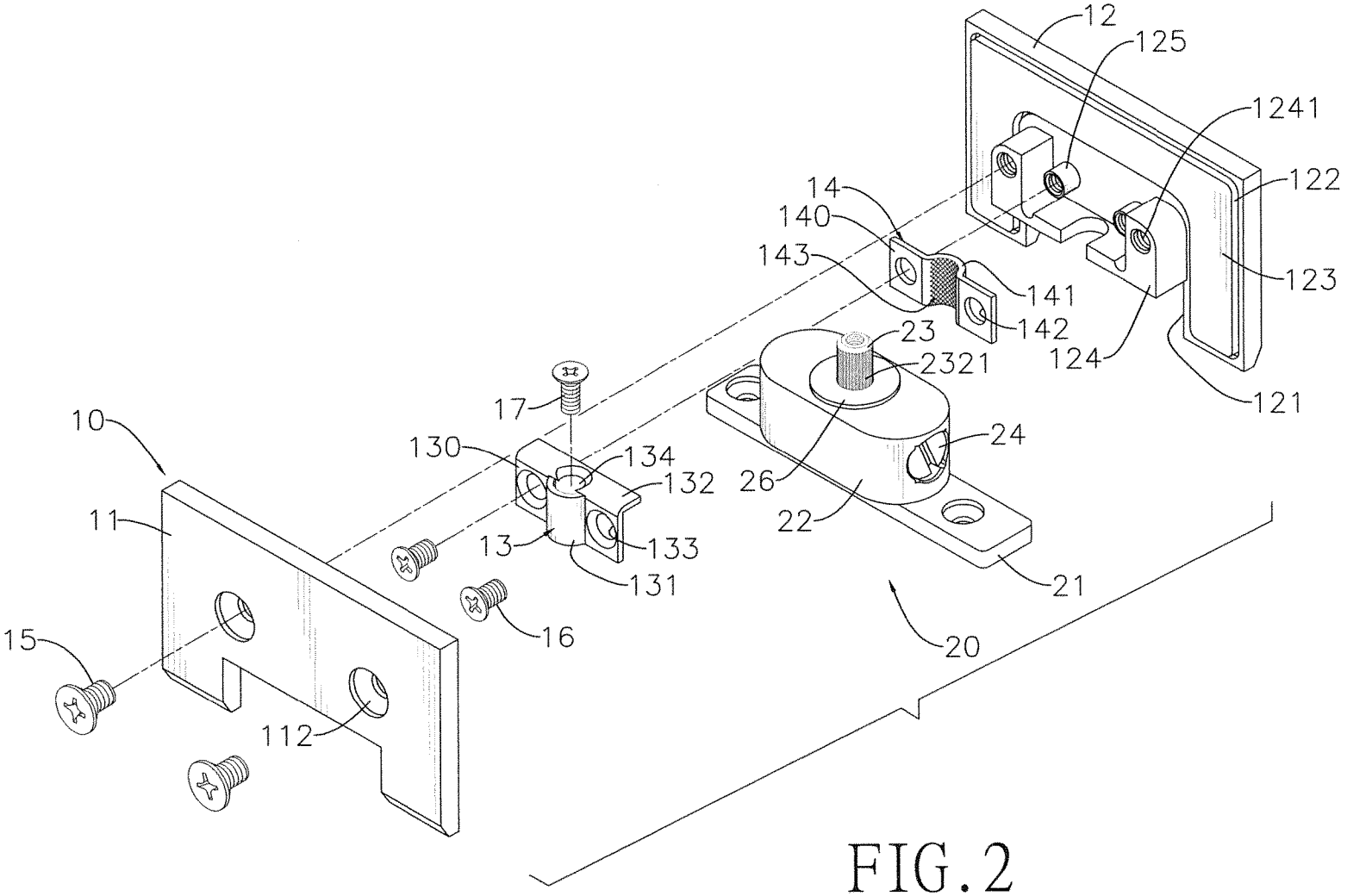
FIG. 2 is a second exploded perspective view of the hinge in FIG. 1.
Figure 4:
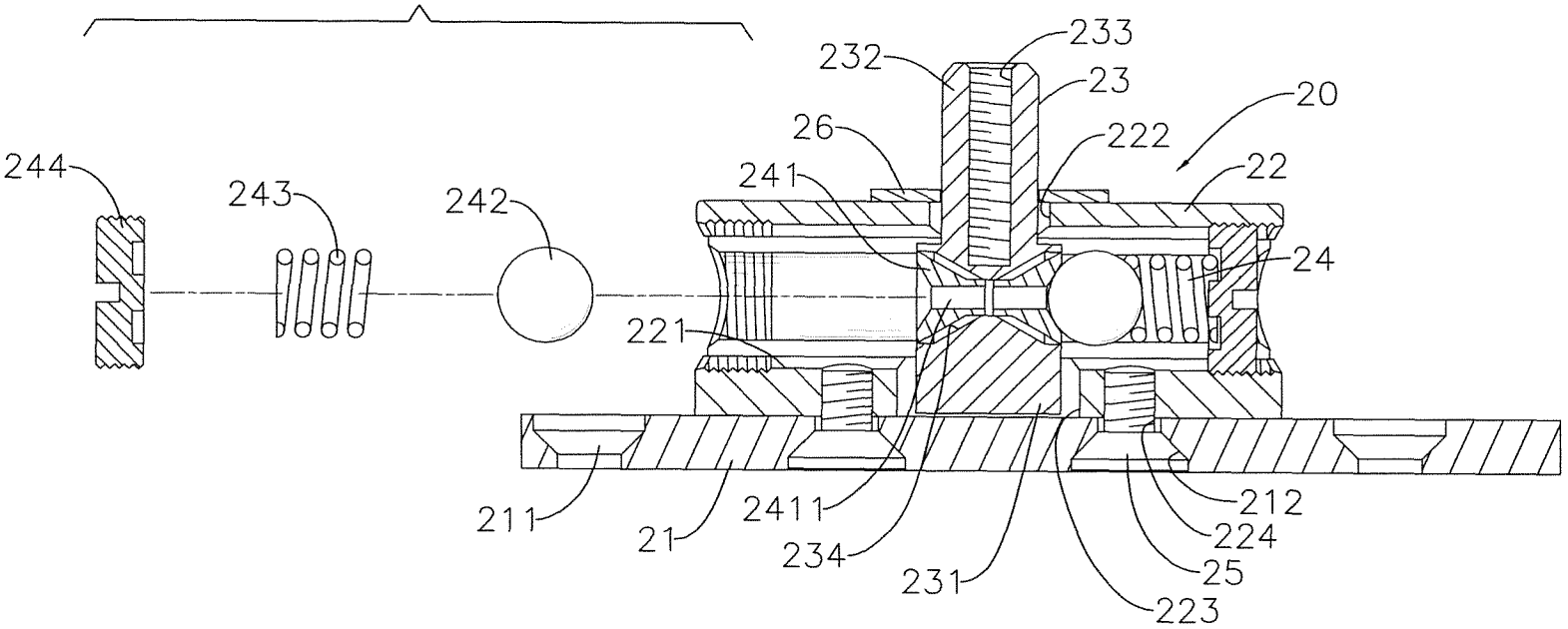
FIG. 4 is an exploded side view in partial section of the hinge in FIG. 1.

With further reference to FIGS. 2 and 4, the pivot assembly 20 includes a securing panel 21, a connecting seat 22, two fasteners 25, a pivot shaft 23, a washer 26, and two positioning sets 24.

The securing panel 21 has two securing holes 211 and two mounting holes 212. The securing holes 211 are separately formed through the securing panel 21. Two fasteners are mounted through the securing holes 211 of the securing panel 21 and are fastened to a stationary wall, such that the securing panel 21 is securely mounted on the stationary wall. The mounting holes 212 of the securing panel 21 are separately formed through the securing panel 21.

The connecting seat 22 is securely mounted on the securing panel 21 and has a proximal end surface, a distal end surface, a transverse channel 221, an outer through hole 222, an inner through hole 223, and two mounting holes 224. The proximal end surface of the connecting seat 22 faces and is attached to the securing panel 21. The transverse channel 221 is transversely formed through the connecting seat 22 and has two opposite end portions. The outer through hole 222 is formed through the distal end surface of the connecting seat 22 and communicates with the transverse channel 221. The inner through hole 223 is formed through the proximal end surface of the connecting seat 22, communicates with the transverse channel 221, and aligns with the outer through hole 222 of the connecting seat 22. The inner through hole 223 is larger than the outer through hole 222 in diameter. The mounting holes 224 of the connecting seat 22 are separately formed through the proximal end surface of the connecting seat 22, are oppositely disposed beside the inner through hole 223 of the connecting seat 22, and respectively align with the mounting holes 212 of the securing panel 21.

The fasteners 25 of the pivot assembly 20 are respectively mounted through the mounting holes 212, 224 of the securing panel 21 and the connecting seat 22 and are fastened to the connecting seat 22. Thus, the connecting seat 22 is securely mounted on the securing panel 21 as well as the stationary wall.

The pivot shaft 23 is rotatably mounted through the outer through hole 222 of the connecting seat 22, and has a first end portion 231, a second end portion 232, a fastening hole 233, and two silencing positioning holes 234.

The first end portion 231 is mounted in the transverse channel 221 and protrudes in the inner through hole 223 of the connecting seat 22. The second end portion 232 is mounted through the outer through hole 222 of the connecting seat 22, protrudes out of the connecting seat 22, and has an end surface and a side surface 2321. The side surface 2321 of the second end portion 232 is toothed or embossed. The first end portion 231 of the pivot shaft 23 is larger than the second end portion 232 of the pivot shaft 23 in diameter.

The fastening hole 233 is formed in the end surface of the second end portion 232 and is threaded. The silencing positioning holes 234 are oppositely formed radially in the first end portion 231 of the pivot shaft 23, respectively correspond in position to the end portions of the transverse channel 221, and communicate with each other. Each of the silencing positioning holes 234 has an inner end connecting with the inner end of the other silencing positioning hole 234. The silencing positioning hole 234 tapers off toward the inner end of the silencing positioning hole 234.

The washer 26 is mounted around the second end portion 232 of the pivot shaft 23 and on the distal end surface of the connecting seat 22.

The positioning sets 24 are respectively mounted in the end portions of the transverse channel 221 of the connecting seat 22. Each of the positioning sets 24 has a silencing positioning element 241, a positioning ball 242, an end cap 244, and a resilient element 243.

The silencing positioning element 241 is substantially funnel-shaped, is mounted in a corresponding one of the silencing positioning holes 234 of the pivot shaft 23, and has a pushing end surface, an inner end, and an oil channel 2411. The pushing end surface is concave. The inner end of the silencing positioning element 241 is opposite to the pushing end surface of the silencing positioning element 241, corresponds in position to the inner end of the corresponding silencing positioning hole 234, and is connected with the inner end of the other silencing positioning element 241. The silencing positioning element 241 tapers off toward the inner end of the silencing positioning element 241. The oil channel 2411 is formed between and through the pushing end surface and the inner end of the silencing positioning element 241, communicates with the oil channel 2411 of the other silencing positioning element 241, and is filled with lubricating grease.

The positioning ball 242 selectively abuts the pushing end surface of the silencing positioning element 241 and the pivot shaft 23. The end cap 244 is fastened to the connecting seat 22. The resilient element 243 is mounted between the positioning ball 242 and the end cap 244 and has two ends respectively pushing against the positioning ball 242 and the end cap 244. With the resilient elements 243 pushing the positioning balls 242, the positioning balls 242 tightly abut the pushing end surfaces of the silencing positioning elements 241.

In the preferred embodiment, the resilient element 243 is a compression spring. The connecting seat 22 further has an inner surface and two internal threads. The inner surface of the connecting seat 22 is defined around the transverse channel 221. The internal threads of the connecting seat 22 are formed on the inner surface of the connecting seat 22 and are respectively disposed in the end portions of the transverse channel 221. The end cap 244 of each of the positioning sets 24 has a circular groove, a driving recess, and an outer thread. The circular groove is formed in an inner end surface of the end cap 244 for receiving a corresponding one of the ends of the resilient element 243. Thus, the resilient element 243 can remain coaxial with the transverse channel 221. The driving recess is formed in an outer end surface of the end cap 244. A tip of a screwdriver can engage in the driving recess so as to rotate the end cap 244. The outer thread is formed on a side surface of the end cap 244 and engages with a corresponding inner thread of the connecting seat 22, such that the end cap 244 is fastened to the connecting seat 22.

Figure 3:
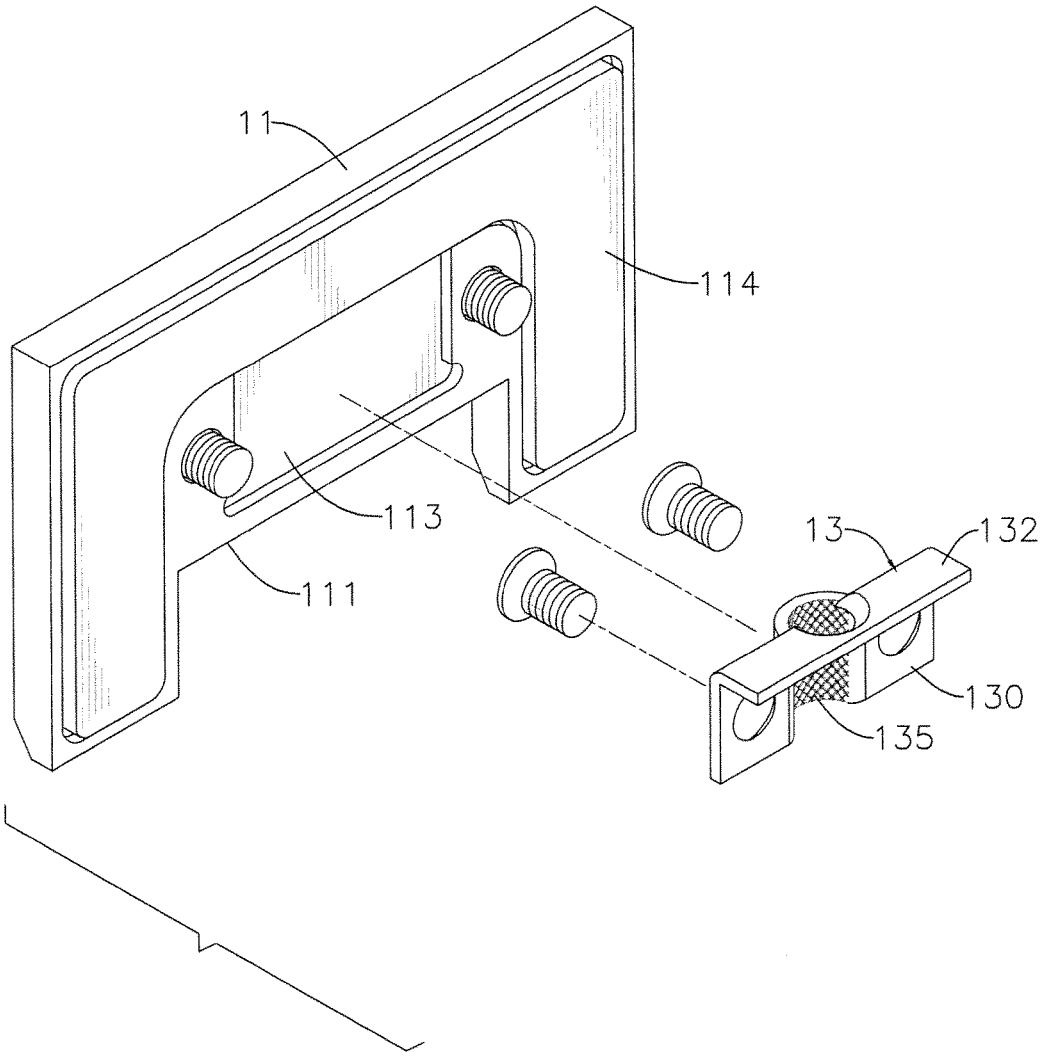
FIG. 3 is an enlarged exploded perspective view of the hinge in FIG. 1.

With further reference to FIG. 3, the holding assembly 10 is mounted on the pivot assembly 20 and securely holds the second end portion 232 of the pivot shaft 23. The holding assembly 10 includes a first holding panel 11, a second holding panel 12, two first fasteners 15, a first holding sheet 13, a second holding sheet 14, two second fasteners 16, and a third fastener 17.

The first holding panel 11 is mounted on the connecting seat 22 of the pivot assembly 20 and has a transverse edge, an inner surface, a first mounting recess 111, two first through holes 112, a first inner recess 113, and a first pad 114. The first mounting recess 111 is formed in the transverse edge of the first holding panel 11, so the first holding panel 11 is substantially U-shaped. The first mounting recess 111 receives the connecting seat 22. The first through holes 112 are separately formed through the first holding panel 11. The first inner recess 113 is formed in the inner surface of the first holding panel 11. The first pad 114 is substantially U-shaped and is mounted in first inner recess 113 of the first holding panel 11.

The second holding panel 12 is mounted on the connecting seat 22 of the pivot assembly 20 and has a transverse edge, an inner surface, a second mounting recess 121, a second inner recess 122, a second pad 123, two mounting seats 124, and two connecting protrusions 125.

The second mounting recess 121 is formed in the transverse edge of the second holding panel 12, so the second holding panel 12 is substantially U-shaped. The second mounting recess 121 corresponds in position to the first mounting recess 111 of the first holding panel 11 and receives the connecting seat 22. The second inner recess 122 is formed in the inner surface of the second holding panel 12. The second pad 123 is substantially U-shaped and is mounted in the second inner recess 122 of the second holding panel 12.

The mounting seats 124 are separately formed on and protrude from the inner surface of the second holding panel 12, are mounted on the washer 26, and respectively correspond in position to the first through holes 112 of the first holding panel 11. Each of the mounting seats 124 has a distal end surface and a connecting hole 1241. The connecting hole 1241 of the mounting seat 124 is formed in the distal end surface of the mounting seat 124 and aligns with a corresponding one of the first through holes 112 of the first holding panel 11.

The connecting protrusions 125 are separately formed on and protrude from the inner surface of the second holding panel 12, are disposed between the mounting seats 124, and are oppositely disposed beside the second end portion 232 of the pivot shaft 23. Each of the connecting protrusions 125 has a distal end surface and a connecting hole. The connecting hole of the connecting protrusion 125 is formed in the distal end surface of the connecting protrusion 125.

The first fasteners 15 are respectively mounted through the first through hole 112 of the first holding panel 11, respectively protrude in the connecting holes 1241 of the mounting seats 124, and are respectively fastened to the mounting seats 124. Thus, the first holding panel 11 and the second holding panel 12 are securely connected with each other.

In the preferred embodiment, each of the first through holes 112 of the first holding panel 11 is a countersunk hole. The connecting holes 1241 of the mounting seats 124 are threaded holes. The first fasteners 15 are screws. Each of the first fasteners 15 has a screw head. The screw heads of the first fasteners 15 are respectively embedded in the first through holes 112 of the first holding panel 11. The first fasteners 15 respectively engage in the connecting holes 1241 of the mounting seats 124.

The first holding sheet 13 is mounted between the first holding panel 11 and the second holding panel 12 and has two first attaching portions 130, a first arc portion 131, a cover portion 132, two second through holes 133, and a third through hole 134.

The first arc portion 131 is formed between the first attaching portions 130, is semicircular in transverse section, and surrounds the second end portion 232 of the pivot shaft 23. The first arc portion 131 has a concave surface 135. The concave surface 135 of the first arc portion 131 is embossed and abuts the toothed side surface 2321 of the second end portion 232 of the pivot shaft 23. The cover portion 132 protrudes from a transverse edge of the first holding sheet 13 and is disposed above the second end portion 232 of the pivot shaft 23.

The second through holes 133 are respectively formed through the first attaching portions 130 of the first holding sheet 13 and respectively align with the connecting protrusions 125 of the second holding panel 12. The third through hole 134 is formed through the cover portion 132 of the first holding sheet 13 and aligns with the fastening hole 233 of the pivot shaft 23.

The second holding sheet 14 is mounted between the first holding panel 11 and the second holding panel 12, is mounted under and is pressed by the cover portion 132 of the first holding sheet 13, and has two second attaching portions 140, a second arc portion 141, and two fourth through holes 142.

The second attaching portions 140 are respectively attached to the first attaching portions 130 of the first holding sheet 13 and are attached to the second holding panel 12 together with the first attaching portions 130 of the first holding sheet 13. The second arc portion 141 is formed between the second attaching portions 140, is semicircular in transverse section, and surrounds the second end portion 232 of the pivot shaft 23. The second arc portion 141 has a concave surface 143. The concave surface 143 of the second arc portion 141 is embossed and abuts the toothed side surface 2321 of the second end portion 232 of the pivot shaft 23.

The fourth through holes 142 are respectively formed through the second attaching portions 140 of the second holding sheet 14 and respectively align with the second through holes 133 of the first holding sheet 13.

The second fasteners 16 are respectively mounted through the second through holes 133 of the first holding sheet 13, are respectively mounted through the fourth through holes 142 of the second holding sheet 14, respectively protrude in the connecting holes of the connecting protrusions 125, and are respectively fastened to the connecting protrusions 125.

The third fastener 17 is mounted through the third through hole 134 of the first holding sheet 13, protrudes in the fastening hole 233 of the pivot shaft 23, and is fastened to the pivot shaft 23.

Thus, the first holding sheet 13 and the second holding sheet 14 are securely attached to the second holding panel 12. The first arc portion 131 of the first holding sheet 13 and the second arc portion 141 of the second holding sheet 14 are mounted around the second end portion 232 of the pivot shaft 23.

In the preferred embodiment, the first holding sheet 13 is mounted between the first holding panel 11 and the pivot shaft 23, and the second holding sheet 14 is mounted between the second holding panel 12 and the pivot shaft 23 and between the mounting seats 124 of the second holding panel 12. Alternatively, the second holding sheet 14 may be mounted between the first holding panel 11 and the pivot shaft 23, and the first holding sheet 13 may be mounted between the second holding panel 12 and the pivot shaft 23 and between the mounting seats 124 of the second holding panel 12.

With the embossed concave surfaces 135, 143 of the arc portions 131, 141 of the holding sheets 13, 14 abutting the toothed side surface of the second end portion 232 of the pivot shaft 23 and with the second fasteners 16 mounted through the through holes 133, 142 of the holding sheet 13, 14 and attached to the connecting protrusions 125 of the second holding panel 12, friction between the holding sheets 13, 14 and the pivot shaft 23 are increased and the holding sheets 13, 14 can tightly hold the pivot shaft 23. Accordingly, the pivot shaft 23 and the holding sheets 13, 14 of the holding assembly 10 do not pivot relative to each other. Moreover, since the third fastener 17 is mounted through the third through hole 134 on the cover portion 134 of the first holding sheet 13 and is fastened to the pivot shaft 23, it is ensured that the pivot shaft 23 and the holding sheets 13, 14 of the holding assembly 10 do not pivot relative to each other. When a glass panel is held between the first holding panel 11 and the second holding panel 12, the first pad 114 and the second pad 123 cushion clamping force applied on the glass panel and prevent the glass panel from breaking.

Figure 5:
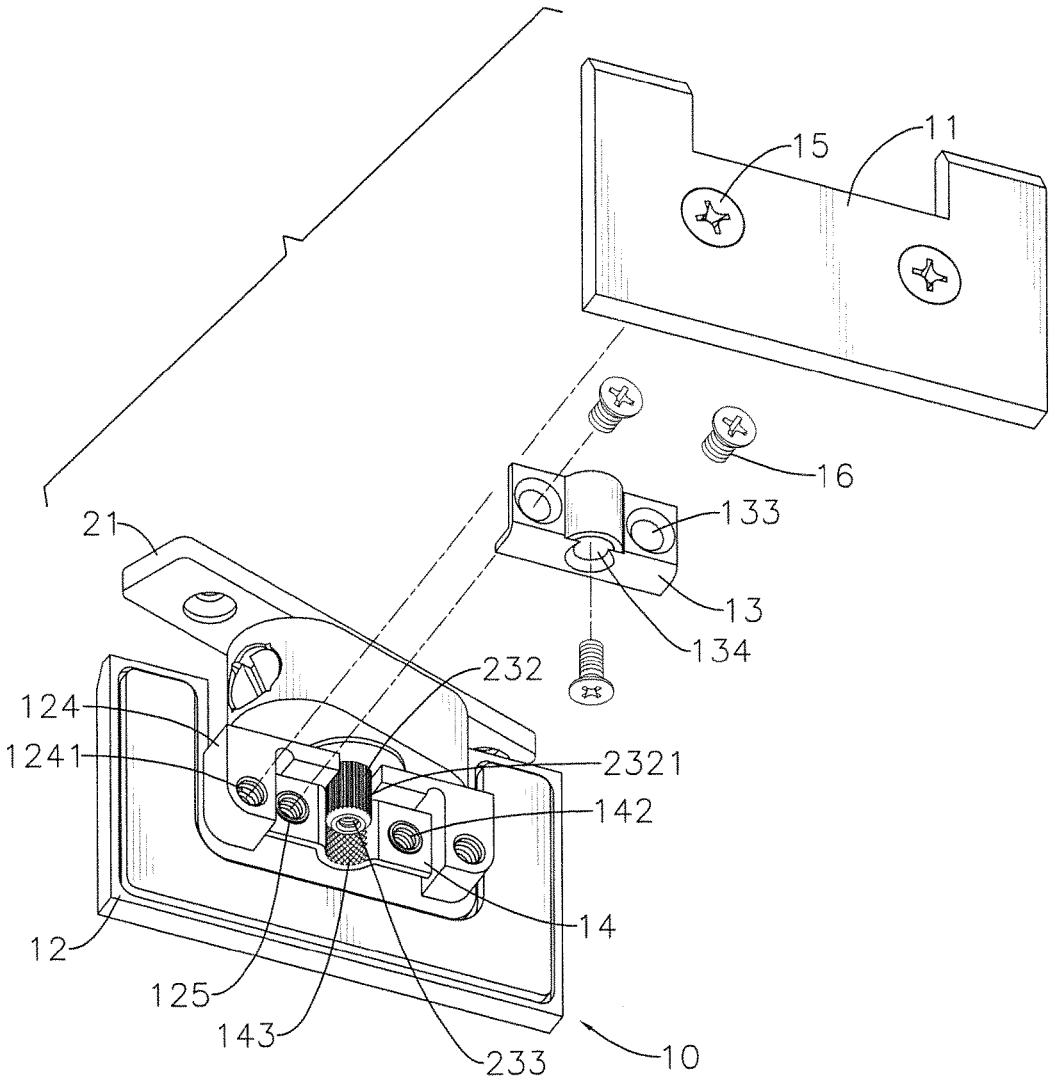
FIG. 5 is a third exploded perspective view of the hinge in FIG. 1.

With reference to FIG. 5, the securing panel 21 is fastened to the stationary wall, such as a ceiling or a bracket. When adjusting the holding assembly 10, the first holding panel 11 is detached from the second holding panel 12 and the second fasteners 16 and the third fastener 17 are loosened from the second holding panel 12. Thus, the second holding panel 11 and the holding sheets 13, 14 can pivot relative to the pivot shaft 23. Accordingly, relative angle between the holding assembly 10 and the pivot assembly 20 is adjusted. Afterwards, when the second holding panel 12 and the holding sheets 13, 14 are turned to a specific position, the second fasteners 16 and the third fastener 17 are tightened to the second holding panel 12 and the first holding panel 11 is mounted onto the second holding panel 12.

Figure 6:
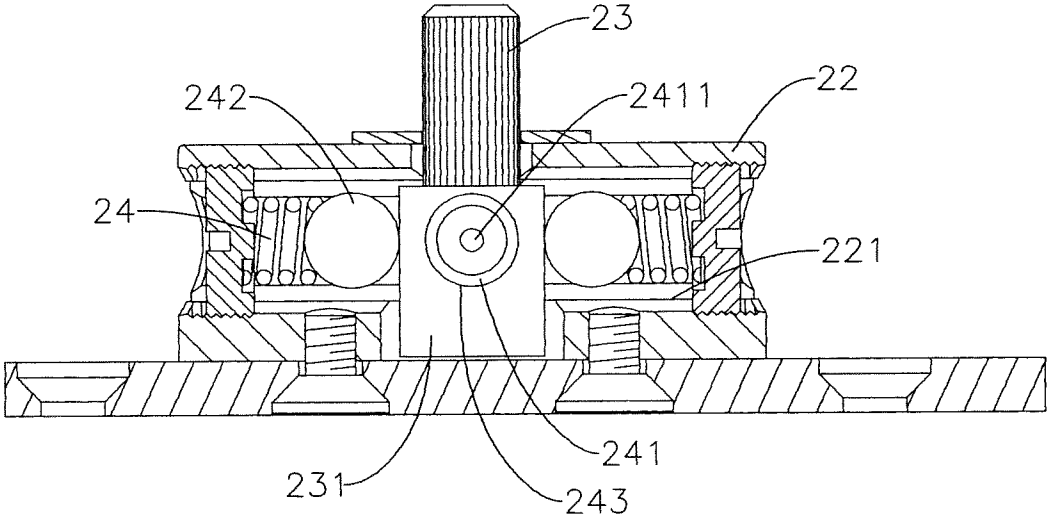
FIG. 6 is an operational side view in partial section of the hinge in FIG. 1, showing a pivot shaft is rotated.
Figure 7:
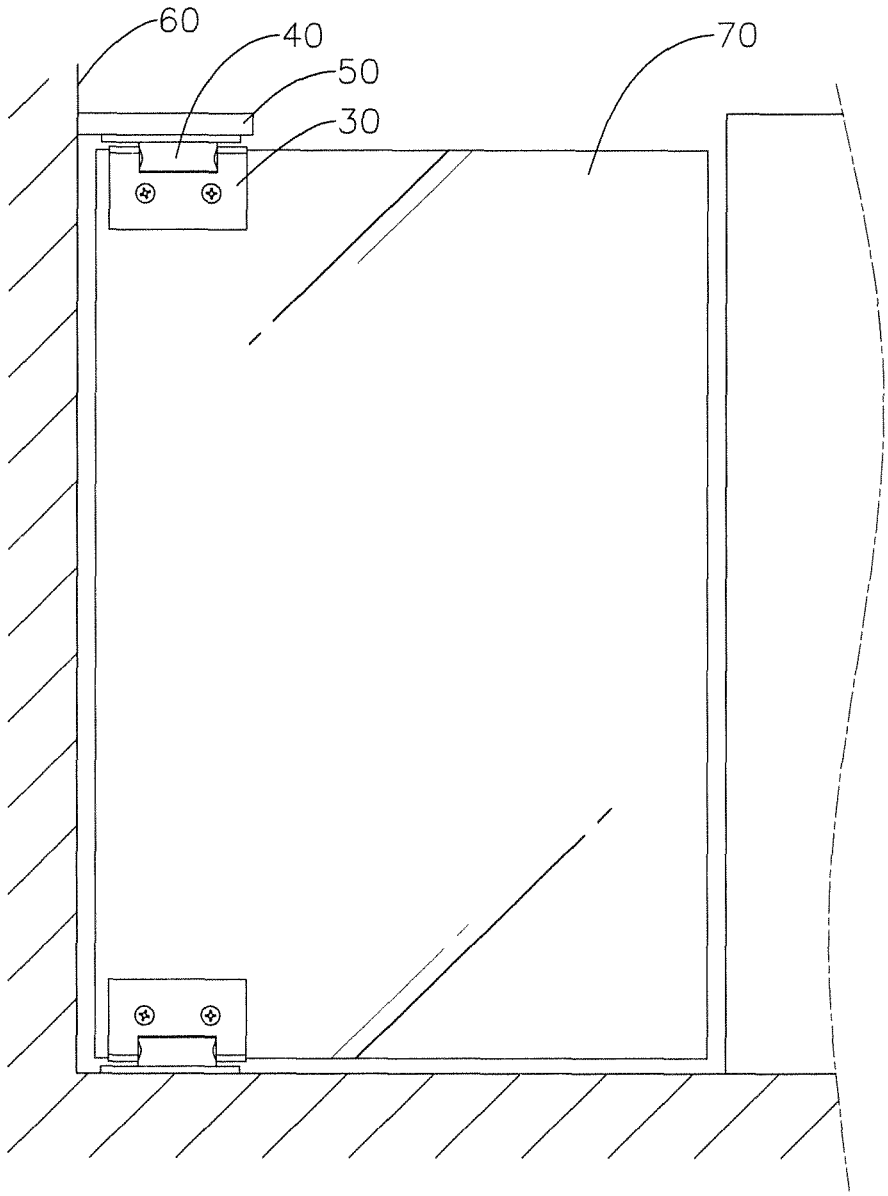
FIG. 7 PRIOR ART
FIG. 7 is an operational side view of a conventional hinge in accordance with the prior art.
Figure 8:
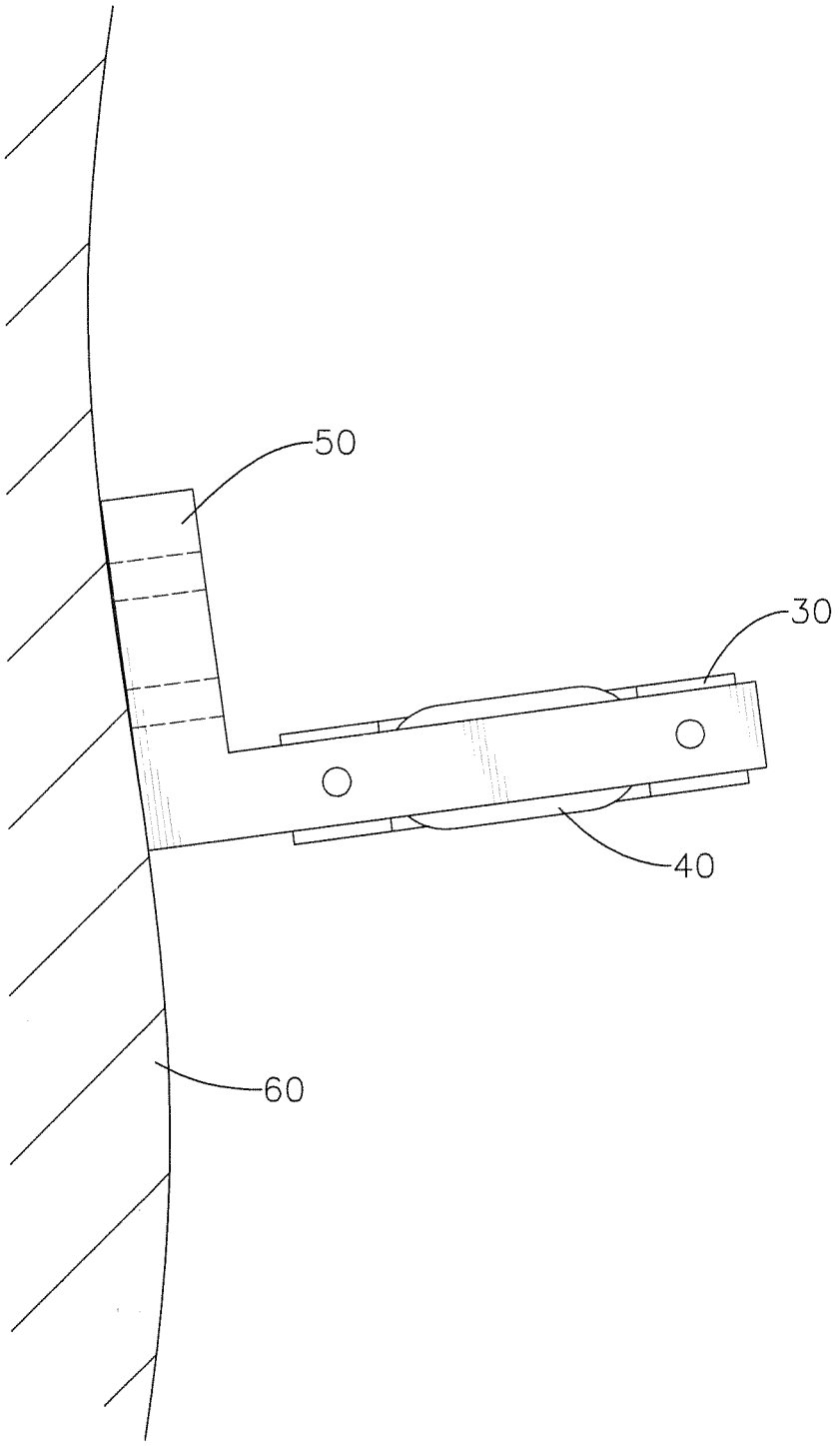
FIG. 8 PRIOR ART
FIG. 8 is an operational top view of the conventional hinge in FIG. 7.
Figure 9:
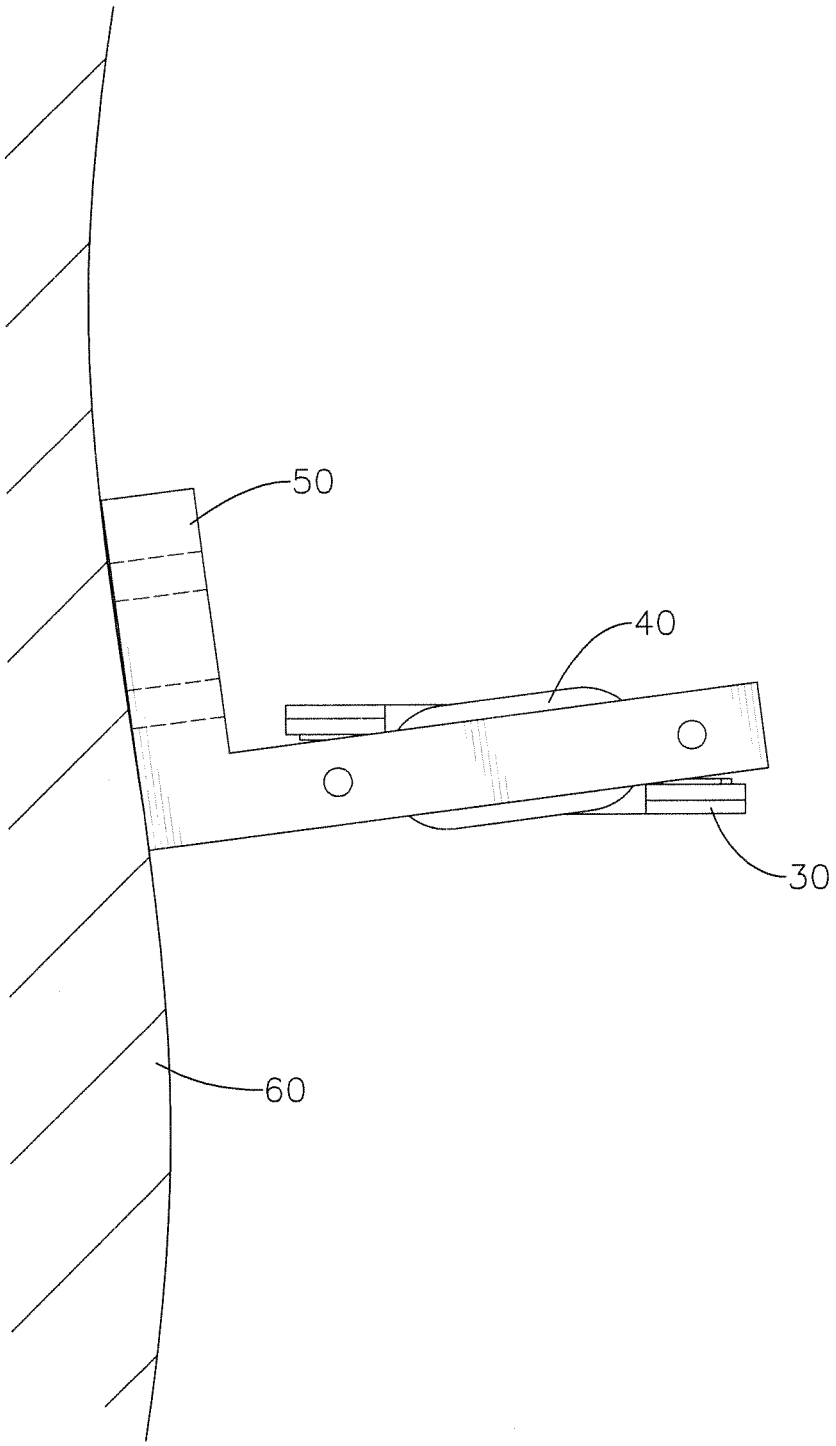
FIG. 9 PRIOR ART
FIG. 9 is another operational top view of the conventional hinge in FIG. 7.

With further reference to FIG. 6, when the glass panel is open, the silencing positioning hole 234 of the pivot shaft 23 and the transverse channel 221 of the connecting seat 22 are staggered. The positioning balls 242 of the positioning sets 24 depart from the pushing end surface of the silencing positioning elements 241 to abut the first end portion 231 of the pivot shaft 23. Since the lubricating grease in the oil channels 2411 of the silencing positioning elements 241 is smeared on the positioning balls 242, the positioning balls 242 can smoothly roll on the pivot shaft 23 and no noise will occur.

Moreover, the positioning balls 242 are only in point of contact with the pivot shaft 23. Therefore, contacting surface and abrasion between the positioning sets 24 and the pivot shaft 23 are both greatly reduced. The silencing positioning elements 241 are mounted in the silencing positioning holes 234 of the pivot shaft 23. When the glass panel and the pivot shaft 23 return to a closed position, the positioning balls 242 stay on the concave pushing end surfaces of the silencing positioning elements 241, such that the pivot shaft 23 is held at a specific position.

Furthermore, as the pivot shaft 23 pivots, the resilient elements 243 of the positioning sets 24 are compressed and apply a pushing force on the positioning balls 242. Since the end caps 244 of the positioning sets 24 are threaded with the connecting seat 22, the end caps 244 can be turned to adjust positions of the end caps 244 in the transverse channel 221 of the connecting seat 22. The pushing force that the resilient elements 243 apply on the positioning balls 242 can be adjusted accordingly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge comprising:

a pivot assembly including a securing panel;

a connecting seat securely mounted on the securing panel and having a distal end surface;

a transverse channel transversely formed through the connecting seat and having two opposite end portions; and an outer through hole formed through the distal end surface of the connecting seat and communicating with the transverse channel;

a pivot shaft rotatably mounted through the outer through hole of the connecting seat and having a first end portion mounted in the transverse channel;

a second end portion mounted through the outer through hole of the connecting seat, protruding out of the connecting seat, and having a side surface being toothed; and two silencing positioning holes oppositely formed radially in the first end portion of the pivot shaft, respectively corresponding in position to the end portions of the transverse channel, and communicating with each other, each of the silencing positioning holes having an inner end connecting with the inner end of the other silencing positioning hole, and the silencing positioning hole tapering off toward the inner end of the silencing positioning hole; and two positioning sets respectively mounted in the end portions of the transverse channel of the connecting seat, and each of the positioning sets having a silencing positioning element mounted in a corresponding one of the silencing positioning holes of the pivot shaft and having a pushing end surface and an inner end, the pushing end surface being concave, the inner end of the silencing positioning element being opposite to the pushing end surface of the silencing positioning element, and the silencing positioning element tapering off toward the inner end of the silencing positioning element;

a positioning ball selectively abutting the pushing end surface of the silencing positioning element and the pivot shaft;

an end cap fastened to the connecting seat; and a resilient element mounted between the positioning ball and the end cap and having two ends respectively pushing against the positioning ball and the end cap; and a holding assembly mounted on the pivot assembly, securely holding the second end portion of the pivot shaft, and including a first holding sheet having two first attaching portions; and a first arc portion formed between the first attaching portions, surrounding the second end portion of the pivot shaft, and having a concave surface, and the concave surface of the first arc portion being embossed and abutting the toothed side surface of the second end portion of the pivot shaft; and a second holding sheet having two second attaching portions respectively attached to the first attaching portions of the first holding sheet; and a second arc portion formed between the second attaching portions, surrounding the second end portion of the pivot shaft, and having a concave surface, and the concave surface of the second arc portion being embossed and abutting the toothed side surface of the second end portion of the pivot shaft.

2. The hinge as claimed in claim 1, wherein the pivot shaft further has a fastening hole formed in an end surface of the second end portion;

the first holding sheet further has a cover portion protruding from a transverse edge of the first holding sheet and disposed above the second end portion of the pivot shaft; and a third through hole formed through the cover portion of the first holding sheet and aligning with the fastening hole of the pivot shaft;

the second holding sheet is mounted under and is pressed by the cover portion of the first holding sheet; and the holding assembly further has a third fastener mounted through the third through hole of the first holding sheet, protruding in the fastening hole of the pivot shaft, and fastened to the pivot shaft.

3. The hinge as claimed in claim 1, wherein the holding assembly further includes a first holding panel mounted on the connecting seat of the pivot assembly and having a first mounting recess formed in a transverse edge of the first holding panel and receiving the connecting seat;

two first through holes separately formed through the first holding panel;

a first inner recess formed in an inner surface of the first holding panel; and a first pad mounted in the first inner recess of the first holding panel;

a second holding panel mounted on the connecting seat of the pivot assembly and having a second mounting recess formed in a transverse edge of the second holding panel and receiving the connecting seat;

a second inner recess formed in an inner surface of the second holding panel;

a second pad mounted in the second inner recess of the second holding panel; and two mounting seats separately formed on and protruding from the inner surface of the second holding panel, and respectively corresponding in position to the first through holes of the first holding panel, each of the mounting seats having a connecting hole, and the connecting hole of the mounting seat formed in a distal end surface of the mounting seat and aligning with a corresponding one of the first through holes of the first holding panel; and two first fasteners respectively mounted through the first through holes of the first holding panel, respectively protruding in the connecting holes of the mounting seats, and respectively fastened to the mounting seats; and the first holding sheet and the second holding sheet are mounted between the first holding panel and the second holding panel; and the second attaching portions of the second holding sheet are attached to the second holding panel together with the first attaching portions of the first holding sheet.

4. The hinge as claimed in claim 2, wherein the holding assembly further includes a first holding panel mounted on the connecting seat of the pivot assembly and having a first mounting recess formed in a transverse edge of the first holding panel and receiving the connecting seat;

two first through holes separately formed through the first holding panel;

a first inner recess formed in an inner surface of the first holding panel; and a first pad mounted in the first inner recess of the first holding panel;

a second holding panel mounted on the connecting seat of the pivot assembly and having a second mounting recess formed in a transverse edge of the second holding panel and receiving the connecting seat;

a second inner recess formed in an inner surface of the second holding panel;

a second pad mounted in the second inner recess of the second holding panel; and two mounting seats separately formed on and protruding from the inner surface of the second holding panel, and respectively corresponding in position to the first through holes of the first holding panel, each of the mounting seats having a connecting hole, and the connecting hole of the mounting seat formed in a distal end surface of the mounting seat and aligning with a corresponding one of the first through holes of the first holding panel; and two first fasteners respectively mounted through the first through holes of the first holding panel, respectively protruding in the connecting holes of the mounting seats, and respectively fastened to the mounting seats; and the first holding sheet and the second holding sheet are mounted between the first holding panel and the second holding panel; and the second attaching portions of the second holding sheet are attached to the second holding panel together with the first attaching portions of the first holding sheet.

5. The hinge as claimed in claim 3, wherein the second holding panel further has two connecting protrusions separately formed on and protruding from the inner surface of the second holding panel and disposed between the mounting seats, and each of the connecting protrusions has a connecting hole formed in a distal end surface of the connecting protrusion;

the first holding sheet further has two second through holes respectively formed through the first attaching portions of the first holding sheet and respectively aligning with the connecting protrusions of the second holding panel;

the second holding sheet further has two fourth through holes respectively formed through the second attaching portions of the second holding sheet and respectively aligning with the second through holes of the first holding sheet; and the holding assembly further includes two second fasteners respectively mounted through the second through holes of the first holding sheet, respectively mounted through the fourth through holes of the second holding sheet, respectively protruding in the connecting holes of the connecting protrusions, and respectively fastened to the connecting protrusions.

6. The hinge as claimed in claim 4, wherein the second holding panel further has two connecting protrusions separately formed on and protruding from the inner surface of the second holding panel and disposed between the mounting seats, and each of the connecting protrusions has a connecting hole formed in a distal end surface of the connecting protrusion;

the first holding sheet further has two second through holes respectively formed through the first attaching portions of the first holding sheet and respectively aligning with the connecting protrusions of the second holding panel;

the second holding sheet further has two fourth through holes respectively formed through the second attaching portions of the second holding sheet and respectively aligning with the second through holes of the first holding sheet; and the holding assembly further includes two second fasteners respectively mounted through the second through holes of the first holding sheet, respectively mounted through the fourth through holes of the second holding sheet, respectively protruding in the connecting holes of the connecting protrusions, and respectively fastened to the connecting protrusions.

7. The hinge as claimed in claim 5, wherein the silencing positioning element of each of the positioning sets further has an oil channel formed between and through the pushing end surface and the inner end of the silencing positioning element, communicating with the oil channel of the other silencing positioning element, and filled with lubricating grease; and the end cap of each of the positioning sets has a circular groove formed in an inner end surface of the end cap for receiving a corresponding one of the ends of the resilient element.

8. The hinge as claimed in claim 6, wherein the silencing positioning element of each of the positioning sets further has an oil channel formed between and through the pushing end surface and the inner end of the silencing positioning element, communicating with the oil channel of the other silencing positioning element, and filled with lubricating grease; and the end cap of each of the positioning sets has a circular groove formed in an inner end surface of the end cap for receiving a corresponding one of the ends of the resilient element.

9. The hinge as claimed in claim 1, wherein the silencing positioning element of each of the positioning sets further has an oil channel formed between and through the pushing end surface and the inner end of the silencing positioning element, communicating with the oil channel of the other silencing positioning element, and filled with lubricating grease; and the end cap of each of the positioning sets has a circular groove formed in an inner end surface of the end cap for receiving a corresponding one of the ends of the resilient element.

10. The hinge as claimed in claim 3, wherein the pivot assembly further includes a washer mounted around the second end portion of the pivot shaft and on the distal end surface of the connecting seat; and the mounting seats of the second holding panel are mounted on the washer.

11. The hinge as claimed in claim 4, wherein the pivot assembly further includes a washer mounted around the second end portion of the pivot shaft and on the distal end surface of the connecting seat; and the mounting seats of the second holding panel are mounted on the washer.

12. The hinge as claimed in claim 5, wherein the pivot assembly further includes a washer mounted around the second end portion of the pivot shaft and on the distal end surface of the connecting seat; and the mounting seats of the second holding panel are mounted on the washer.

13. The hinge as claimed in claim 6, wherein the pivot assembly further includes a washer mounted around the second end portion of the pivot shaft and on the distal end surface of the connecting seat; and the mounting seats of the second holding panel are mounted on the washer.

14. The hinge as claimed in claim 7, wherein the pivot assembly further includes a washer mounted around the second end portion of the pivot shaft and on the distal end surface of the connecting seat; and the mounting seats of the second holding panel are mounted on the washer.

15. The hinge as claimed in claim 8, wherein the pivot assembly further includes a washer mounted around the second end portion of the pivot shaft and on the distal end surface of the connecting seat; and the mounting seats of the second holding panel are mounted on the washer.

* * * * *